United States Patent [19]

Tomiser, Jr. et al.

[11] Patent Number: 4,766,806

[45] Date of Patent: Aug. 30, 1988

[54] FLUSH MOUNT WHOLE HOUSE FAN SHUTTER

[75] Inventors: Frank J. Tomiser, Jr., St. Louis; James P. Shawcross, St. Louis County, both of Mo.

[73] Assignee: Emerson Electric Co., St. Louis, Mo.

[21] Appl. No.: 146

[22] Filed: Jan. 2, 1987

[51] Int. Cl.[4] ..... F24F 7/10

[52] U.S. Cl. ..... 98/42.1; 98/42.16

[58] Field of Search ..... 98/38.5, 38.6, 38.7, 98/38.8, 42.01, 42.07, 42.09, 42.10, 42.11, 42.12, 42.16, 42.1

[56] References Cited

U.S. PATENT DOCUMENTS

| | | | |
|---|---|---|---|
| 1,931,156 | 10/1933 | Persons | 98/42.1 |
| 2,464,000 | 3/1949 | Schild | 98/42.1 |
| 2,722,170 | 11/1955 | Broberg | 49/463 |
| 4,287,815 | 9/1981 | Henderson | 49/463 |
| 4,485,356 | 10/1985 | Brown et al. | 98/42.1 |
| 4,594,940 | 6/1986 | Wolbrink et al. | 98/42.1 |
| 4,628,802 | 12/1986 | Steiner et al. | 98/42.1 |

*Primary Examiner*—L. I. Schwartz

*Attorney, Agent, or Firm*—Polster, Polster and Lucchesi

[57] ABSTRACT

A shutter assembly for a whole house fan is disclosed which can be flush mounted (i.e., substantially coplanar) with the underside surface of a ceiling so as to close off an opening in the ceiling leading to a whole house fan located thereabove. The shutter assembly comprises a frame somewhat larger than the opening and adapted to be flush mounted to the underside of the ceiling surrounding the opening. The frame is comprised of side and end members. A bracket at the intersection of the frame members securely joins the frame members together. The brackets have temporary attachment tabs for temporarily holding the frame in place with respect to the ceiling sheathing until the frame is securely secured to the ceiling structure. These temporary securing tabs are carried by the brackets and are spaced from the portion of the frame which is flush mounted to the underside of the ceiling so as to hold the ceiling between the frame and the tabs, and thus hold the frame assembly in place. At least some of these tabs are selectively movable between a retracted position in which the frame may be inserted upwardly through the opening, and an extended position in which the tabs extend out over the ceiling thereby to hold the shutter assembly in place with respect to the ceiling.

11 Claims, 4 Drawing Sheets

FLUSH MOUNT WHOLE HOUSE FAN SHUTTER

BACKGROUND OF THE INVENTION

This invention relates to whole house fan assemblies, and more particularly to a flush mount shutter assembly for closing off the opening in a ceiling leading to a whole house fan when the fan is de-energized, and for automatically opening thus permitting the movement of air from within the house to the fan when the fan is energized. Even more specifically, this invention relates to a shutter assembly which may be readily flush mounted (i.e., located substantially in coplanar relation with the underside of the ceiling) such that the shutter assembly does not substantially protrude downwardly from the ceiling.

Whole house fans are often installed in a center hallway or at some other central location within a home so as to draw cool outside air into the house through open windows and to exhaust air from within the house into an attic space above the ceiling of the house. Sufficient vent areas are provided in the attic space of the house so as to permit heated air within the attic space to be exhausted to the outside. In this manner, the air within the house is constantly exchanged and heated air within the attic space is exhausted. Thus, the temperature of the air within a house can be maintained at a comfortable level during hot weather, thus lessening or eliminating the requirement for air conditioning. Of course, the energy required to drive such a whole house fan is appreciably less than is required for central air conditioning.

Prior art whole house fans typically had shutter assemblies associated with them which were intended to be installed on the bottom face of the ceiling so as to close off the opening therethrough. However, these shutter assemblies oftentimes extended down from the ceiling a distance of several inches so as to permit the movable louvers of the shutter assembly to be swung from a horizontal closed position in which they blocked off the air flow to the opening in the ceiling to a vertical position in which they were raised toward the whole house fan thereby to substantially open the flow path through the shutter assembly and through the opening in the ceiling to the whole house fan installed thereabove. However, it was generally recognized that these prior art shutter assemblies which extended down from the ceiling a substantial distance took up space within the living area of the house and effectively cut down on the floor-to-ceiling height within a hallway or the like. Additionally, these prior art shutter assemblies were relatively expensive and required substantial additional package volume to accommodate them. This additional volume required more space for shipping and warehousing.

With known prior art shutters, it was generally considered to be a two-person job to install the shutter. Typically, the shutter assembly would be lifted into place on the bottom of the ceiling and, while one person held the shutter assembly firmly in position, another person would attached screws or other fasteners which securely held the shutter assembly in place. Because a large number of whole house fans are installed by homeowners, it would be advantageous if the homeowner could install the entire whole house fan assembly, including the shutter assembly, without help from other persons.

SUMMARY OF THE INVENTION

Among the several objects and features of this invention may be noted the provision of a shutter assembly for a whole house fan which may be substantially flush mounted with respect to the ceiling such that the shutter assembly is substantially coplanar with the underside of the ceiling thereby to minimize the floor-to-ceiling distance taken up by the shutter assembly;

The provision of such a flush mount shutter assembly which, when located substantially coplanar with the undersurface of the ceiling, does not require that a ceiling joist extending across the opening be removed or cut so as to permit movable louvers of the shutter assembly to move between their closed to opened positions;

The provision of such a flush mount shutter assembly which may readily be installed and securely mounted within the ceiling opening by one person from below with the use of only simple hand tools;

The provision of such a flush mount shutter assembly which may be positively secured at its center to a ceiling joist thereabove, and which may also be readily secured at its outer ends to the ceiling sheathing, even in the event ceiling joists are not available at the outer ends of the shutter assembly;

The provision of such a flush mount shutter assembly which is readily adjustable so that the outer ends of the shutter assembly may be readily secured to the ceiling sheathing, regardless of the thickness of the sheathing;

The provision of such a flush mount shutter assembly which permits the ready attachment of a louver biasing spring;

The provision of a flush mount shutter asssembly in which the frame members are rigidly secured together at their corners in a simple and expeditious manner; and The provision of such a flush mount shutter assembly which may be shipped in a minimum volume.

Other objects and features of this invention will be in part apparent and in part pointed out hereinafter.

Briefly stated, a flush mount shutter assembly of the present invention is adapted to be mounted in substantially flush relation (i.e., substantially coplanar) to the inner or lower face of a ceiling to close an opening in the ceiling, with the opening providing communication between a room and a fan located above the ceiling. The shutter assembly of the present invention comprises a frame somewhat larger than the opening in the ceiling. The frame is adapted to be flush mounted to the underside of the ceiling surrounding the opening. The frame is comprised of side and end members with a bracket at the intersection of the frame members for securely joining the frame members together. These brackets each have means for holding the frame in place with respect to the ceiling until the frame is securely fastened to the ceiling. This last-mentioned securing means comprises a plurality of tabs carried by the brackets and spaced from the portion of the frame to be flush mounted to the underside of the ceiling a distance sufficient so as to be engageable with the ceiling from above and thereby to hold the ceiling captive between the frame and the tabs. At least certain of these tabs are movable between a retracted position in which the frame may be inserted upwardly through the opening in the ceiling without interference between these certain tabs and the ceiling and an extended position in which the tabs extend out over the upper surfaces of the ceiling thereby to hold the shutter assembly with respect to the ceiling.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
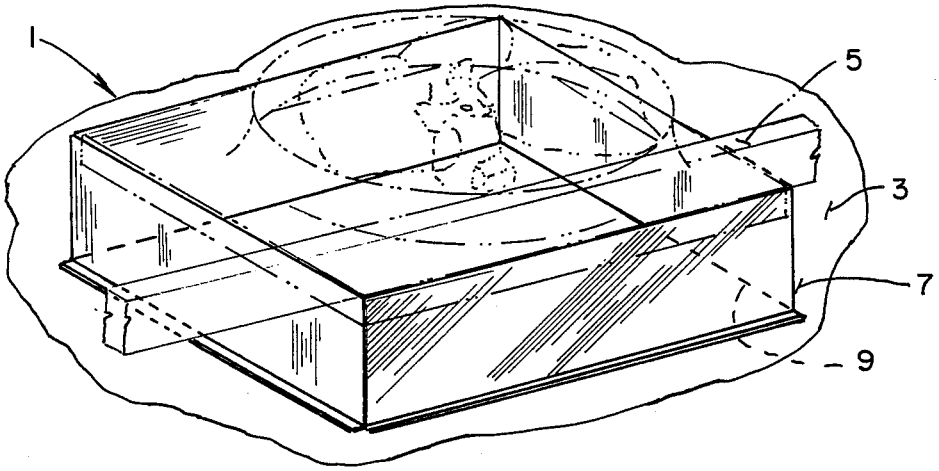
FIG. 1 is an exploded perspective view, illustrating a portion of a ceiling (shown in solid lines) having a generally rectangular opening therewithin with a ceiling joist (shown in phantom) extending across the opening, and with a whole house fan assembly (also shown in phantom) installed within the ceiling structure above the opening, and further illustrating a flush mount shutter assembly of the present invention adapted to be applied to the underside of the ceiling for closing the opening in the ceiling.
Figure 1:
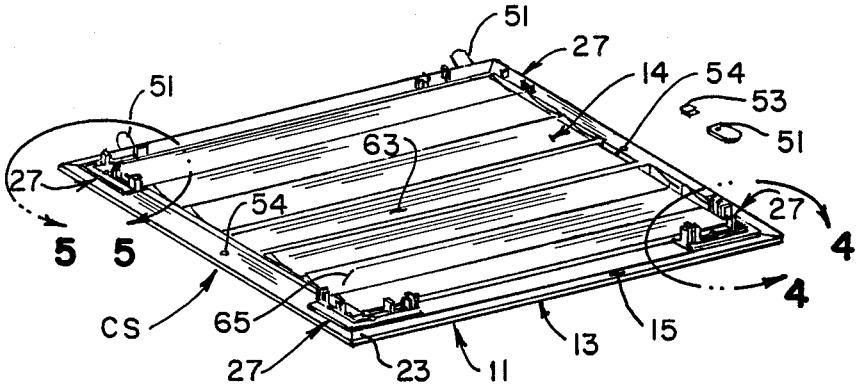

Referring now to the drawings, and more particularly to FIG. 1, a whole house fan assembly, as shown in phantom, is indicated in its entirety by reference character 1. The whole house fan assembly 1 is adapted to be installed above a ceiling 3 of a room or hallway within a home, and is securely supported within the attic space of the house by means of one or more ceiling joists 5 supporting the ceiling. The ceiling 3 includes ceiling sheathing (e.g., drywall sheathing) 7 secured to the underfaces of joists 5 and having an opening 9 (shown in solid lines) cut therein for fan 1 so as to permit air within the room to be drawn through the opening by the fan and discharged into the attic space of the house from which air via appropriate vents (not shown) is exhausted to the outside. As is typical with whole house fans, cool air is drawn through the open windows of the house into the living space of the house and is exhausted into the attic space above the ceiling, thus displacing hot air within the attic space which in turn is discharged through attic vents. Such whole house fans are in widespread use and provide good cooling and ventilation without the expense or energy consumption of central air conditioning.

As is typical, opening 9 in ceiling sheathing 7 is typically closed by a shutter assembly which includes a plurality of louvers movable from a closed position in which communication to the ceiling opening and the whole house fan thereabove is blocked, and an open position in which communication between the interior of the house and the fan is open. The shutter assembly herein described, which constitutes a part of this invention, is indicated in its entirety by reference character 11, and is shown to be a so-called flush mount shutter assembly. As used in this specification, the term "flush mount" is defined to mean a shutter system which, when viewed from below ceiling 3, appears to be substantially planar with the undersurface of the ceiling closing the opening 9 therein. It will be appreciated, however, that the shutter assembly of the present invention does protrude down below the under surface of ceiling sheathing 7 a distance of approximately 0.193 inch (0.49 cm.), a distance which is substantially more flush than other prior art shutter assemblies which protruded down below the underside of the ceiling a distance of three-four inches (7.6–10.2 cm.). Further, it will be appreciated that the flush mount shutter assembly 11 of the present invention does not take up any substantial amount of head space within the room or hallway above which the whole house fan 1 is located.

Figure 9:
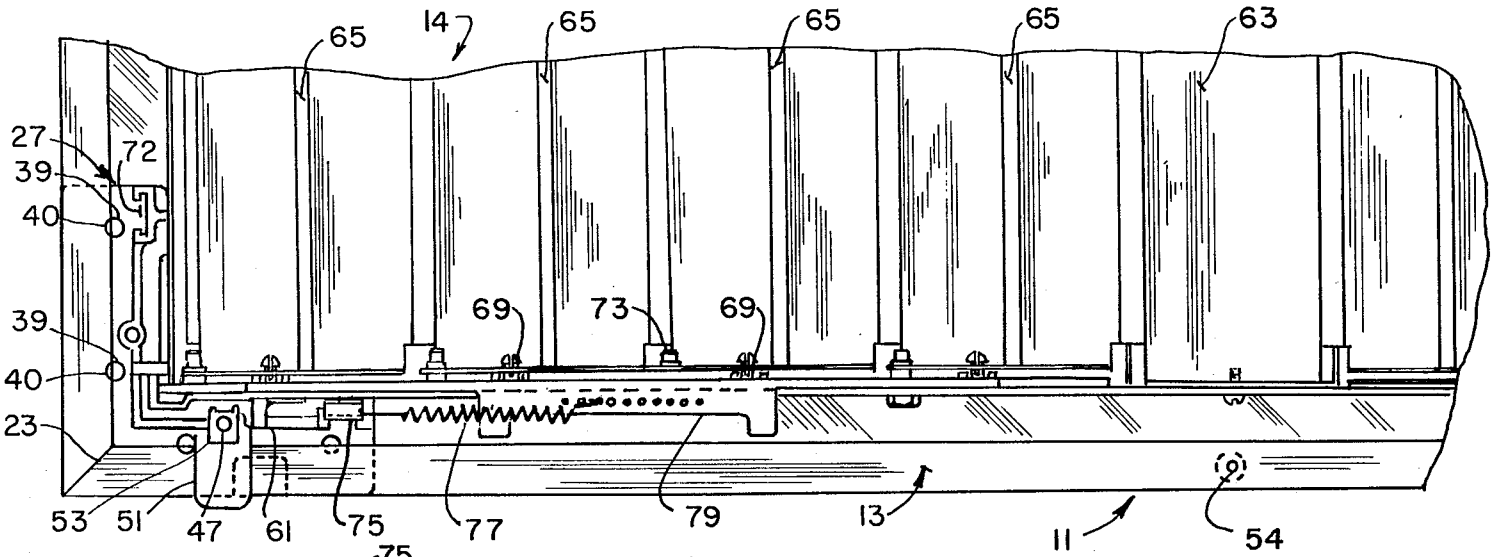
FIG. 9 is a top plan view of one corner of the shutter assembly, illustrating movable louvers and a stationary center louver, and further illustrating a corner bracket having one of the above-noted tabs carried thereby in its extended position, and further illustrating a tension spring for cushioning the movable louvers as they return to their closed position.
Figure 10:
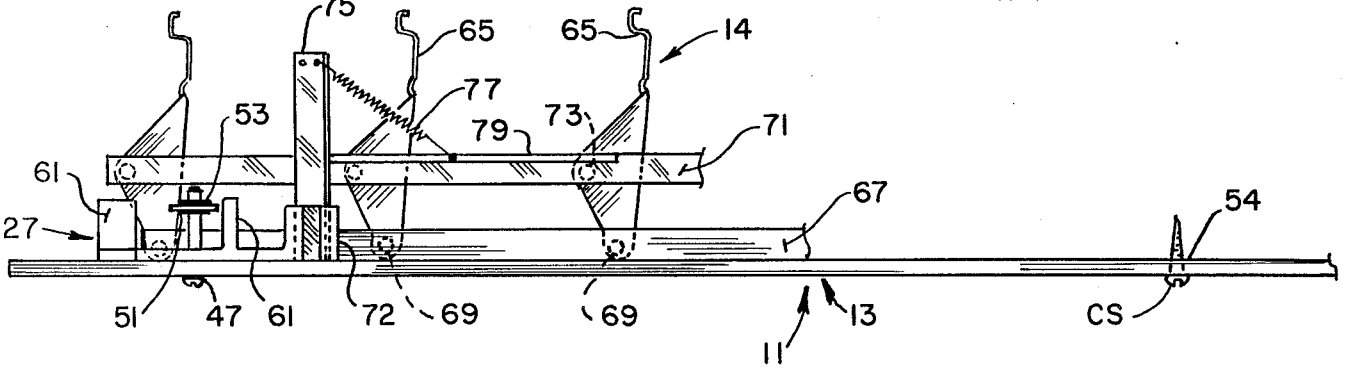
FIG. 10 is a side elevational view of the shutter assembly shown in FIG. 9, with the movable louvers in their fully opened positions.

More specifically, flush mount shutter assembly 11 of the present invention comprises a generally rectangular outer frame 13 formed of sheet metal or the like, which will hereinafter be described in detail. The flush mount shutter assembly 11 further comprises a louver assembly, as generally indicated at 14, carried by shutter frame 13 and movable between a closed position, as shown in FIGS. 1 and 9, in which the movable louvers substantially block communication between the room or hallway below opening 9 and whole house fan 1, and an open position, as generally illustrated in FIG. 10, in which communication from within the room or house below the whole house fan is open.

Figure 8:
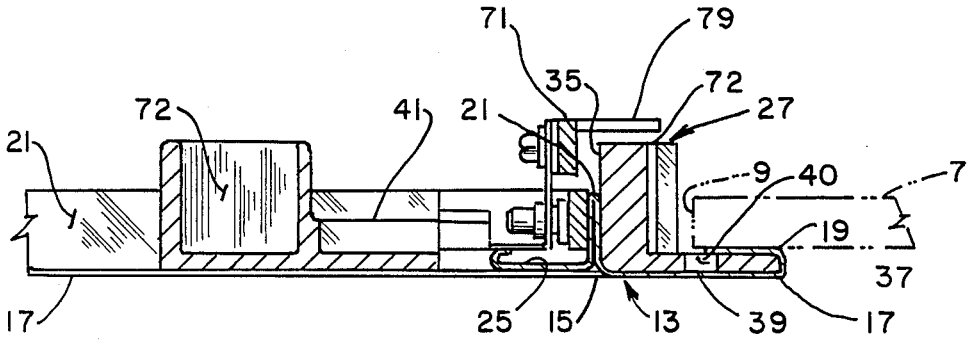
FIG. 8 is a cross sectional view of the corner bracket and the shutter frame, taken along line 8—8 of FIG. 4.

Shutter frame assembly 13 comprises four side frame members 15 formed of sheet metal and being of one-piece, unitary construction. As shown in FIG. 8, each side frame member 15 comprises a base 17 having a so-called capture member 19 extending upwardly from the outer end of the base and extending back over the base. At the inner end of the base, a vertical web 21 is formed of the sheet metal doubled back on itself so as to constitute an elongated web running lengthwise of the frame member thereby to impart substantial stiffness to the frame. As shown in FIG. 8, this elongate web 21 is spaced inboard of opening 9 and thus can protrude above the bottom face of ceiling sheathing 7. As indicated at 23 in FIGS. 4–7, the ends of each of the side frame members 15 are mitered at a 45 degree angle, such that when the side frame members are joined together in end-to-end, perpendicular abutting relation, the mitered ends thereof form a right angle for frame 13. An inner flange 25, generally at the level of base 17, extends inwardly of the frame from vertical web 21.

Figure 2:
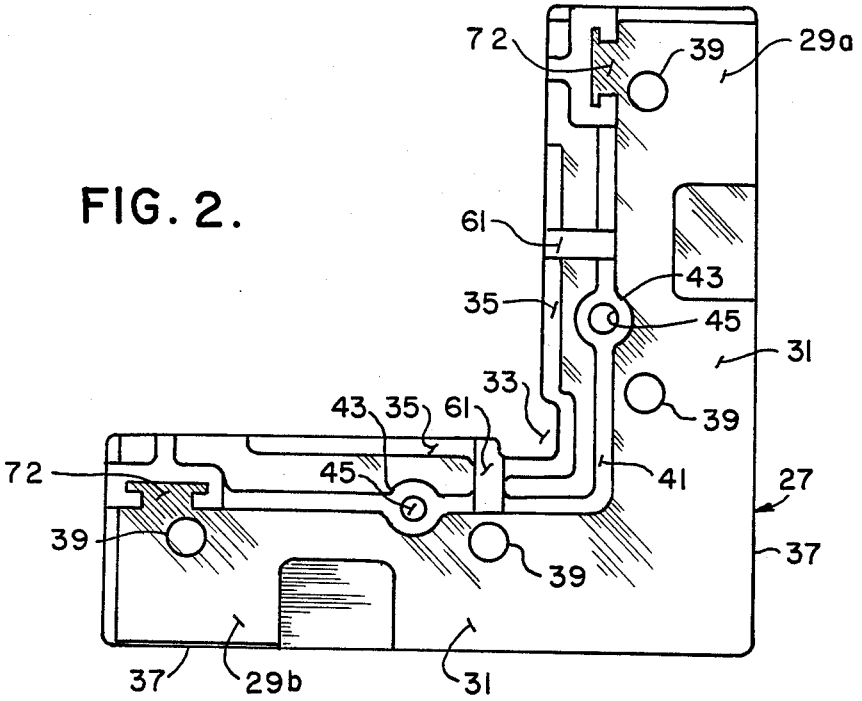
FIG. 2 is a top plan view of a corner bracket for securing the side and end frame members of the flush mount shutter assembly of the present invention together.
Figure 3:
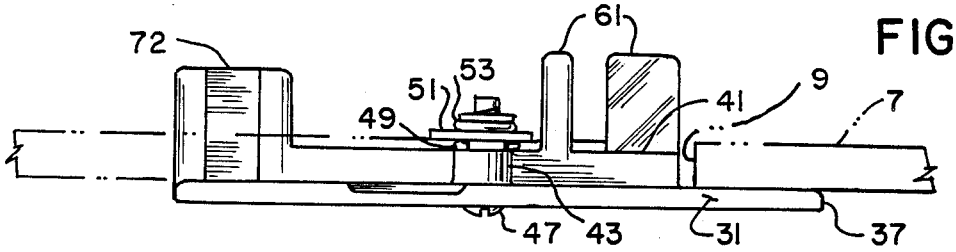
FIG. 3 is a bottom side elevational view of the corner bracket shown in FIG. 2, with the ceiling sheathing shown in phantom.
Figure 4:
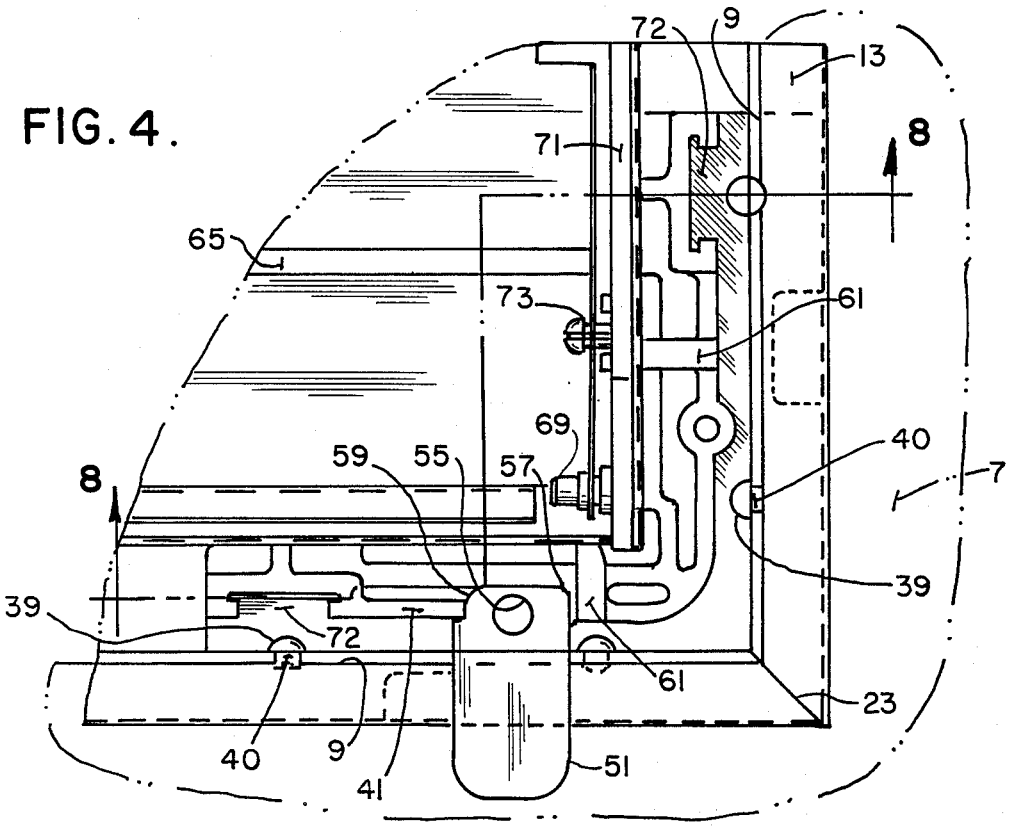
FIG. 4 is top plan view of the corner bracket as it is installed in the shutter assembly frame for securely holding the frame members together at the corners of the frame, and illustrating a securement tab carried by the bracket, with the securement tab in its extended position, and being prevented from rotating from its extended position by means of a stop carried by the bracket in close proximity to the tab.

Further in accordance with this invention, a rigid, unitary corner bracket 27, as best illustrated in FIGS. 2–4, is positively held captive between the vertical webs 21 and the capture flanges 19 of two respective perpendicularly intersecting side frame members 15 at each corner of frame 13 for positively and rigidly securing the side frame members together. Preferably, corner bracket 27 is molded of a suitable synthetic resin material, such as a 30 percent glass-filled polypropylene or the like, so as to provide a rigid interconnection between adjacent, intersecting side frame members 15. The unitary corner bracket 27 includes a pair of perpendicular, generally planar legs **29*a*, 29*b*, with the lower planar portion of these legs constituting a corner bracket base 31. The inner corner of the base is undercut, as indicated at 33, for the purpose of permitting the louver pivot rail to be captured between the frame vertical web 21 and the corner support relief area 33. The inner vertical edges of upright flanges 35 bear against the outer faces of webs 21 of side frame members 15**.

As best shown in FIG. 8, the bottom of bracket base 31 lies on top of base portion 17 of side frame member 15 and capture flange 19 of the side frame member extends inwardly back over the top of the bracket base 31, with the outer edge 37 of the bracket base abutting the portion of the frame member between base 17 and capture flange 19. As best shown in FIG. 2, a plurality of frame member attachment apertures 39 are provided in bracket base 31 such that portions of capture flange 19 may be deformed downwardly into apertures 39 thereby to securely join side frame members 15 to the bracket brace. It will thus be understood that with adjacent side frame members 15 being in mitered, abutting relation with one another so as to be perpendicular, with a respective bracket 27 fitted therein in the manner as above described, and with the portions 40 of capture flanges 19 deformed downwardly into apertures 39 in the base portion 31 of corner brackets 27 thereby to positively secure the frame members 15 to one another a rigid mitered joint 23 is provided between the abutting frame members.

Further referring to bracket 27, as shown in FIGS. 2–5, the bracket is provided with a raised rib 41 which extends around the inner portion of the bracket. This rib includes bosses 43 each of which has a screw opening 45 therethrough. As shown best in FIG. 3, a screw 47 is inserted into screw opening 45 of boss 43 from below and an O-ring 49 is frictionally engaged on the outer end of the threaded portion of screw 47. An attachment tab 51, which will be described in detail hereinafter, is installed on the screw on top of O-ring 49. A so-called speed nut 53 is applied to the tab and is threadably received on screw 47 in such manner that the nut will not turn relative to tab 51 upon turning movement of screw 47.

Figure 5:
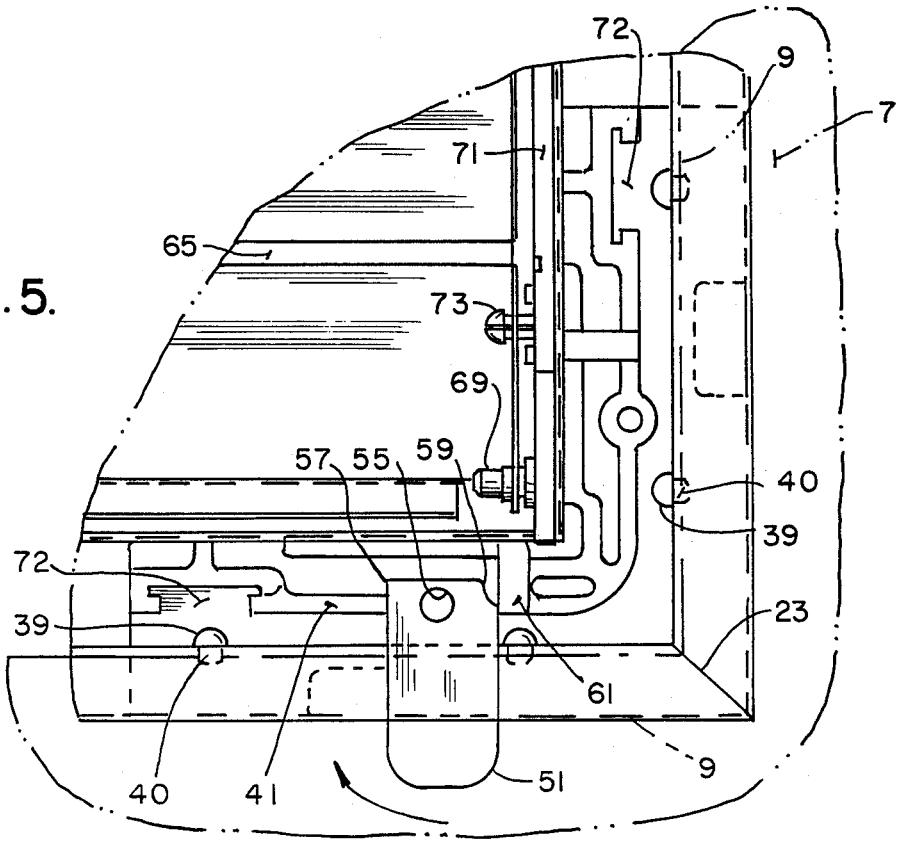
FIG. 5 is a view similar to FIG. 4, illustrating another securement tab carried by the bracket, with this securement tab being readily movable or rotatable from below the shutter assembly from a retracted position (not shown) in which the tab is clear of the ceiling opening, to an extended position (as shown)

More specifically, tab 51, as best shown in FIGS. 4 and 5, is a flat member made out of rigid sheet metal or the like, having an aperture 55 at its inner or rear end for receiving screw 47. At one rear corner of the tab, a square corner 57 is provided and at the other corner of the tab, a rounded corner 59 is provided for purposes as will appear. Further, corner bracket 27 has a stop 61 integrally molded therein and extending up above the level of raised rib 41 inboard of (i.e., toward corner cut-out 33) relative to boss 43.

Figure 6:
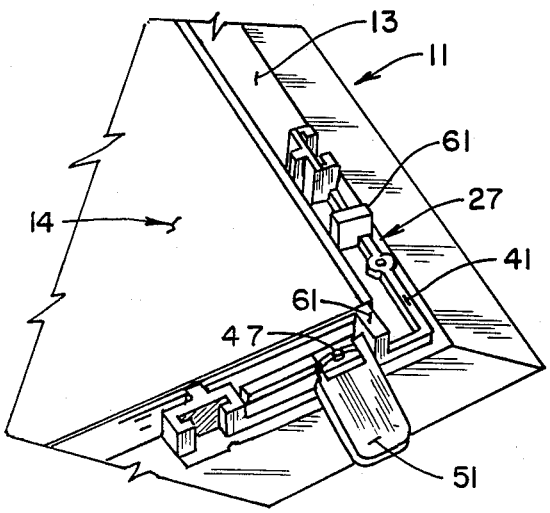
FIGS. 6 and 7 are partial perspective views of a corner of the shutter assembly, illustrating a tab, similar to the tab in FIG. 4, in its extended position and, in FIG. 7, illustrating a tab similar to that shown in FIG. 5 as the tab is selectively rotated from below between its retracted and extended positions.
Figure 7:
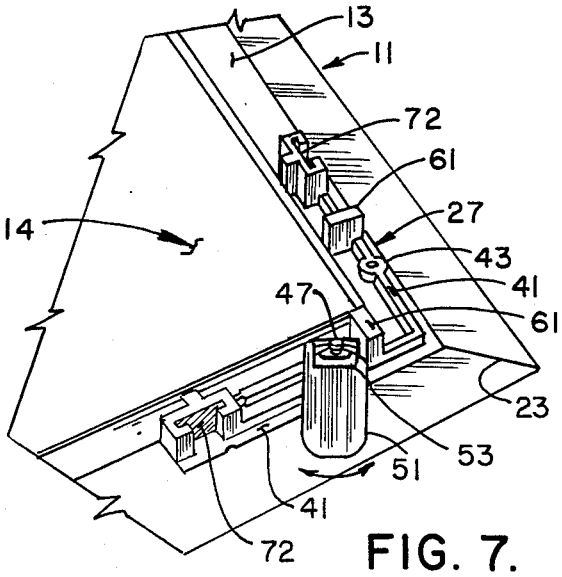

In accordance with this invention and as can be best seen in FIG. 3, with O-ring 49, tab 51, and speed nut 53 installed on screw 47 and with tab 51 substantially above the level of ceiling sheathing 7, tab 51 may be rotated from an extended or operative position (as shown in FIGS. 4–6) to a retracted position (not shown) in which the tab is rotated about screw 47 in clockwise direction (as shown by the arrow in FIG. 5) and in which the tab is clear of opening 9 in ceiling sheathing 7. It will further be appreciated that with a tab 51 installed in the manner as shown in FIG. 4 with square corner 57 proximate stop 61, the stop will cooperate with square corner 57 so as to substantially prevent rotation in either clockwise or counterclockwise direction of tab 51 relative to the corner bracket. In this manner tabs 51, with corner 57 in close proximity to stop 61, the tab is positively retained in its extended position. However, with tab 51 installed in the manner as illustrated in FIG. 5 with the rounded corner 59 in close proximity to the adjacent stop 61, it will be appreciated that by turning screw 47 from below, tab 51 may be rotated about one-quarter turn (e.g., about 90 degrees) between its extended position (as it is illustrated in FIG. 5) and its retracted position (not shown) in which the tab 51 in FIG. 5 is clear of the ceiling sheathing margins defining opening 9 therein.

In this manner, two of the tabs 51 may be provided on one side of frame 13 and installed on their respective brackets in the manner as illustrated in FIG. 4 so as to positively prevent them from rotating from their extended or operative position. Additionally, one or more other tabs 51 may be provided on corner brackets 27 on the opposite side of frame 13 in the position illustrated in FIG. 5 such that these other brackets may be rotated from below from their retracted to their extended positions. In this manner, with two of the tabs 51 fixed in their extended positions and with two other tabs on the opposite side of the frame in their retracted positions, the flush mount shutter assembly 11 may be lifted upwardly and one side thereof inserted into opening 9 in ceiling sheathing 11 such that the tabs 51 in their fixed position overlie the upper reaches of the ceiling sheathing 7 adjacent opening 9 therein. Then, the shutter assembly can be rotated upwardly about the above-noted one side such that the entire shutter assembly fits into opening 9 and is substantially flush with the underside of the ceiling. The tabs 51 in their fixed extended positions bear on the upper face of ceiling sheathing 7 and support the one side of the frame. The installer may then insert a screwdriver into the heads of the screws 47 on the opposite side of frame 13 and, by rotating the screws approximately one-quarter turn, may rotate the tabs 51 on that side from their retracted to their extended positions in which they, too, overlie the upper surface of the ceiling sheathing 7 adjacent opening 9. By fully tightening screws 47 on both sides of frame 13, both sides of the frame are thus positively drawn into flush abutting engagement with the underside of the ceiling and with portions of the ceiling sheathing being held captive between tabs 51 and frame 13. With the shutter assembly so secured to ceiling sheathing 7, central screws CS may be inserted through appropriate center apertures 54 in frame 13 so as to securely engage the undersurface of joist 5.

It will be particularly noted that the provision of O-ring 49 on screws 47 is for the pufpose of holding tabs 51 above the level of the upper surface of ceiling sheathing 7 as the shutter assembly 13 is moved into opening 9 so as to prevent inadvertent interference between tabs 51 and the ceiling sheathing until such time as it is desired to tighten screws 47 thereby to draw tabs 51 into clamping engagement with the upper surface of the ceiling sheathing. Of course, it will be appreciated that the O-ring holders 49 do not, in any substantial manner, interfere with the tightening of the screws.

As heretofore noted, the flush mount shutter assembly 11 includes a louver assembly 14 having a fixed center slat or louver 63 intended to be disposed directly below the uncut ceiling joist 5 spanning the opening 9 in ceiling sheathing 7. Further, the louver assembly includes a plurality of movable louvers 65 on both sides of the fixed center louver 63, with the movable louvers being pivotally attached to frame 13 and being movable between a closed position in which the louvers are substantially horizontal, thus substantially closing off opening 9 in ceiling sheathing 7 (as shown in FIG. 9), and an open position (as shown in FIG. 10) when the louvers are rotated to a nearly vertical upstanding position, thus permitting air within the room below shutter assembly 11 to freely communicate with the whole house fan located thereabove. Movable louvers 65 are gravity biased toward their closed positions. Specifically, the movable louvers 65 are pivotally attached to a fixed rail 67 extending along one side of frame 11. Pivot pins, as indicated at 69, pivotally attach the movable louvers at one end thereof to fixed rail 67. The movable louvers are also pivotally attached to a movable rail 71 by means of pins 73 at a location on the movable louvers distal from pivot pins 69. Each of the corner brackets 27 is provided with one or more receptacles 72 for selectively receiving an upright spring bracket 75 therein. Spring bracket 75 is shown to be a rigid formed metal member extending upwardly above the level of corner bracket 27. A tension coil spring 77 is interposed between spring bracket 75 and a spring attachment member 79 provided on movable rail 71. Upon de-energization of fan 1, and upon movable louvers 65 falling toward their closed positions, spring 77 cushions the louvers and prevents them from slamming closed. It will be appreciated that by providing receptacles 72 in corner brackets 27, the spring attachment bracket 75 may be readily inserted therein and rigidly secured therein with respect to frame 13. By providing removable spring brackets 75, the brackets need not be in place during packaging and transport of the louver assembly thus decreasing the volume of the package in which the shutter assembly is packaged.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

What is claimed is:

1. A shutter assembly adapted to be mounted in substantially flush relation to the inner face of a ceiling and to close an opening in said ceiling, said opening providing communication between a room and a fan located above said ceiling, said shutter assembly comprising a frame somewhat larger than said opening and being adapted to be substantially flush mounted to the underside of the ceiling surrounding said opening, said frame being comprised of a plurality of frame members, a bracket at the intersection of two of said frame members for securely joining these intersecting frame members together, means for holding said frame in place with respect to said ceiling until said frame may be securely fastened to said ceiling, said holding means comprising a plurality of tabs carried by said brackets and spaced from the portion of said frame flush mounted to the underside of said ceiling thereby to hold said ceiling captive between said frame and said tabs, at least one of said tabs being movable between a retracted position in which position said frame may be inserted upwardly through said opening in said ceiling, and an extended position in which said at least one tab extends out over said ceiling thereby to hold said shutter assembly secure with respect to said ceiling.

2. A shutter assembly as set forth in claim 1 wherein at least one of said tabs is pivotally movable relative to said frame between said retracted position and said extended position.

3. A shutter assembly as set forth in claim 1 further comprising means for permanently securing said shutter assembly to said ceiling while said shutter assembly is held in place with respect to said ceiling by said tabs.

4. A shutter assembly as set forth in claim 1 further comprising a stop adjacent the pivotal attachment of said at least one tab so as to prevent rotation of this respective last said tab from its extended position when a portion thereof is in engagement with said stop.

5. A shutter assembly as set forth in claim 1 wherein said frame comprises a plurality of frame members which abut one another to form corners of said frame, said shutter assembly comprising a bracket for securing said frame members together at each of said corners.

6. A shutter assembly as set forth in claim 5 wherein said bracket has a first portion secured to a first one of said frame members, and a second portion secured to a second frame member, at least one of said bracket portions having means thereon for mounting one of said tabs, said bracket carrying a stop adjacent said tab mounting means for preventing rotation of said tab from its extended position in at least one direction.

7. A shutter assembly as set forth in claim 6 wherein said tab has a rounded corner and a square corner at its end pivotally attached to said bracket, said stop being spaced relative to said pivotal attachment of said tab to said bracket such that with said rounded corner of said tab proximate said stop, said tab may only be rotated in one direction from its extended position toward its retracted position, and such that with said square corner of said tab proximate said stop, said tab is fixed in its extended position.

8. A shutter assembly as set forth in claim 7 wherein said frame and said ceiling opening are generally rectangular, said frame having at least one of said tabs fixed in said extended position on one side thereof, and having at least one of said tabs on the opposite side thereof movable between its retracted and extended positions such that with said tabs on said opposite side retracted, said frame may be inserted into said ceiling opening with said extended tabs cooperating with said ceiling on said one side of said opening thereby to hold one side of said frame with respect to said ceiling and then said opposite side may be inserted into said opening with the tabs thereon retracted, said tabs on said opposite side being selectively movable from their retracted to their extended position thereby to hold said opposite side of said frame with respect to said ceiling.

9. A shutter assembly as set forth in claim 7 wherein said ceiling includes at least one joist extending across said opening, and wherein said shutter assembly further comprises fastener means for securing said frame to said joist.

10. A shutter assembly as set forth in claim 5 wherein said frame members are of sheet metal construction and enclose at least a portion of said bracket with the ends of said frame members abutting one another, areas of said frame members being deformable into recesses provided in said bracket for positively securing said frame members to said bracket, and for positively holding the frame members together in assembled relation.

11. A shutter assembly as set forth in claim 5 wherein said shutter assembly comprises a plurality of louvers pivotally attached to said frame and being movable between an opened and a closed position; said bracket having a receptacle for receiving a spring arm, a spring interposed between said spring arm and said movable louvers for biasing said louvers toward their open position.

* * * * *